US006667430B1

(12) United States Patent
Liao

(10) Patent No.: US 6,667,430 B1
(45) Date of Patent: Dec. 23, 2003

(54) CHIN REST FOR A VIOLIN

(76) Inventor: Ping Sen Liao, No. 63, Ann Lin 2nd St., Yan Chao Shiang, Kaohsiung Hsien (TW)

( * ) Notice: Subject to any disclaimer, the term of this patent is extended or adjusted under 35 U.S.C. 154(b) by 0 days.

(21) Appl. No.: 10/412,326

(22) Filed: Apr. 14, 2003

(51) Int. Cl.[7] ..... G10D 1/02
(52) U.S. Cl. ..... 84/279; 84/278; 84/280
(58) Field of Search ..... 84/278, 279, 280, 84/290, 281

(56) References Cited

U.S. PATENT DOCUMENTS 5,208,409 A * 5/1993 Roulet ..... 84/278
5,419,226 A * 5/1995 Kun ..... 84/280
6,031,163 A * 2/2000 Cullum et al. ..... 84/279
6,278,044 B1 * 8/2001 Ruan ..... 84/279

* cited by examiner

*Primary Examiner*—Kimberly Lockett
(74) *Attorney, Agent, or Firm*—Rosenberg, Klein & Lee

(57) ABSTRACT

A violin chin rest includes a chin rest pad, an adjusting device and a fixture. The adjusting device comprises an adjusting rod, a connecting base and a sleeve secured to the fixture. The adjusting rod has one end connected to the chin rest pad while the other end is in a ball-shaped bolt. The connecting base has male threads on an outer surface and an arcuate surface at the top inner wall to be engaged with the adjusting rod. The sleeve also comprises female threads at the inner wall to be threaded with the connecting base to move upward or downward with respect to the connecting base. The sleeve is secured to the fixture.

5 Claims, 6 Drawing Sheets

CHIN REST FOR A VIOLIN

BACKGROUND OF THE INVENTION

1. Field of the Invention

This invention relates to a violin chin rest, and more particularly, to a chin rest which height and angle are adjustable to make a user more comfortable.

2. Description of the Prior Art

A chin rest has been widely used by a musician to assist in holding a violin during performance. As shown in FIG. 6, the most common chin rest comprises a chin rest pad A in an arcuate shape plate, a fixture B, and a pair of adjusting devices C. The adjusting devices C are adjustable to move upward or downward with respect to the chin rest pad A. The fixture B comprises a pair of feet B11 at one end to be inserted into the chin rest pad A, and a pair of rods B1 at the other end of the fixture B being secured to a blocking plate B2. The blocking plate B2 will engage with the bottom of a violin D to support the chin rest pad A on the violin D firmly whereas the adjusting devices C are able to move upward or downward thereat.

However, the conventional chin rest can only be adjusted the height and not the angle, thus a user's chin can only touch a portion of the rest pad A, which causes uncomfortable.

SUMMARY OF THE INVENTION

It is the primary object of the present invention to provide a violin chin rest, which height and angle are both adjustable.

It is another object of the present invention to provide a violin chin rest, which is easy to operate and more comfortable to a performer.

It is a further object of the present invention to provide a violin chin rest, which pad can be replaced separately, therefore is cost effectiveness.

DETAILED DESCRIPTION OF THE PREFERRED EMBODIMENT

Figure 1:
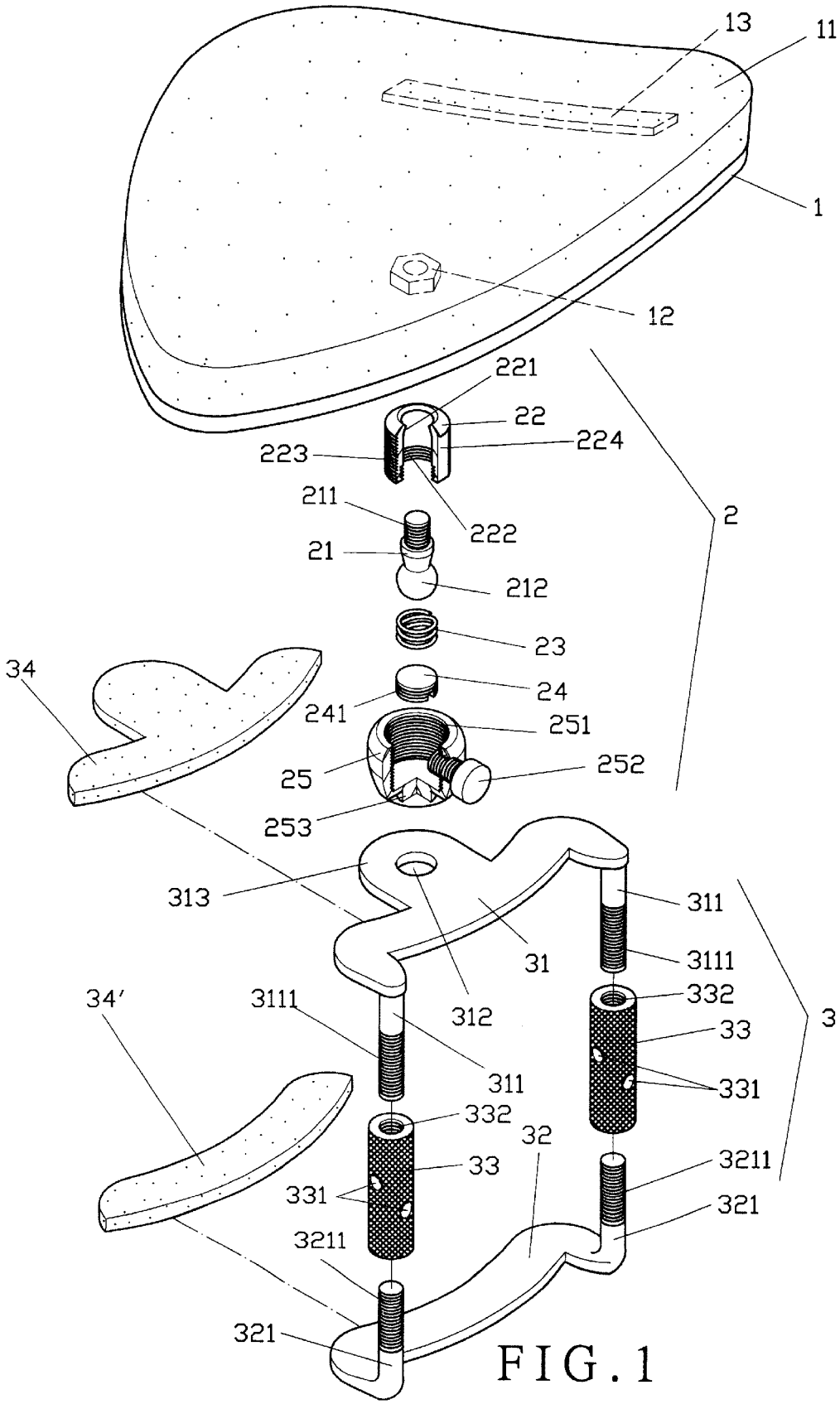
FIG. 1 is an exploded view of the present invention.

A violin chin rest of the present invention comprises a chin rest pad 1, an adjusting device 2 and a fixture 3.

The chin rest pad 1 has an arcuate surface attached with a soft pad 11 to provide a user a soft and comfortable touching feeling. A threaded blind hole 12 is formed at the bottom of the chin rest pad 1 for the adjusting device 2 to be secured thereat. A buffer pad 13 made of foam is secured to one side of the bottom of the chin rest pad 1 to prevent scratches on the surface of a violin 4 and also functions as an anti-skid device.

The adjusting device 2 comprises an adjusting rod 21, a connecting base 22, a spring 23, a block 24 and a sleeve 25. The adjusting rod 21 comprises a threaded section 2111 at the upper end and a bolt 212 at the lower end thereof. The connecting base 22 has a hollow body with an arcuate surface 221 at the top inner end, and comprises male threads 223 around the outer surface and female threads 222 around the inner wall thereon. The male threads 223 are formed with a vertical stop line 224. The block 24 is also formed with male threads 241 around the outer surface. The sleeve 25 comprises female threads 251 around the inner wall, a position bolt 252 inserted into the sleeve 25, and a boss 253 at the bottom end thereof.

The fixture 3 comprises a pair of supporting plates 31 and 32 at the top and the bottom end respectively. Each of the supporting plates 31 and 32 has a pair of rods 311 and 321 extending from respective sides thereon. Both the rods 311 and 321 comprise threads 3111 and 3211 at the endmost. A pair of sleeves 33 provides with female threads 332 therein to be connected with the threads 3111 and 3211 of the rods 311 and 321 in a threaded manner to adjust the distance between the two rods 311 and 321 with respect to each other by threading the sleeves 33. The sleeves 33 further provide a plurality of holes 331 adapted to insertion of a wrench. The supporting plate 31 extends a portion to form a lug 313 thereat with a hole 312 thereon. A pair of soft pads 34 and 34' is adapted to use with the supporting plates 31 and 32 to prevent scratches on the violin surface.

Figure 2:
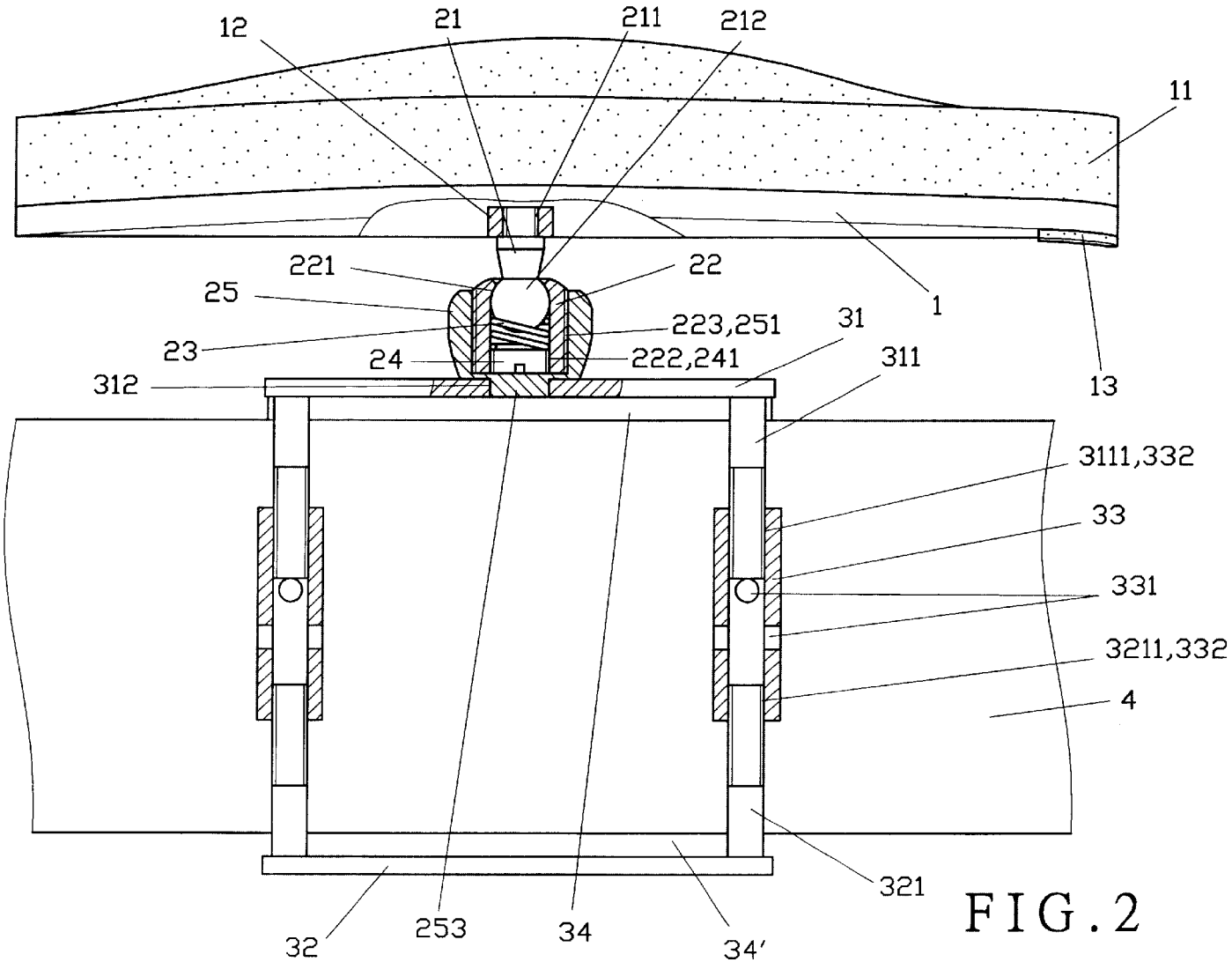
FIG. 2 is a side cross-sectional view of the present invention.
Figure 3:
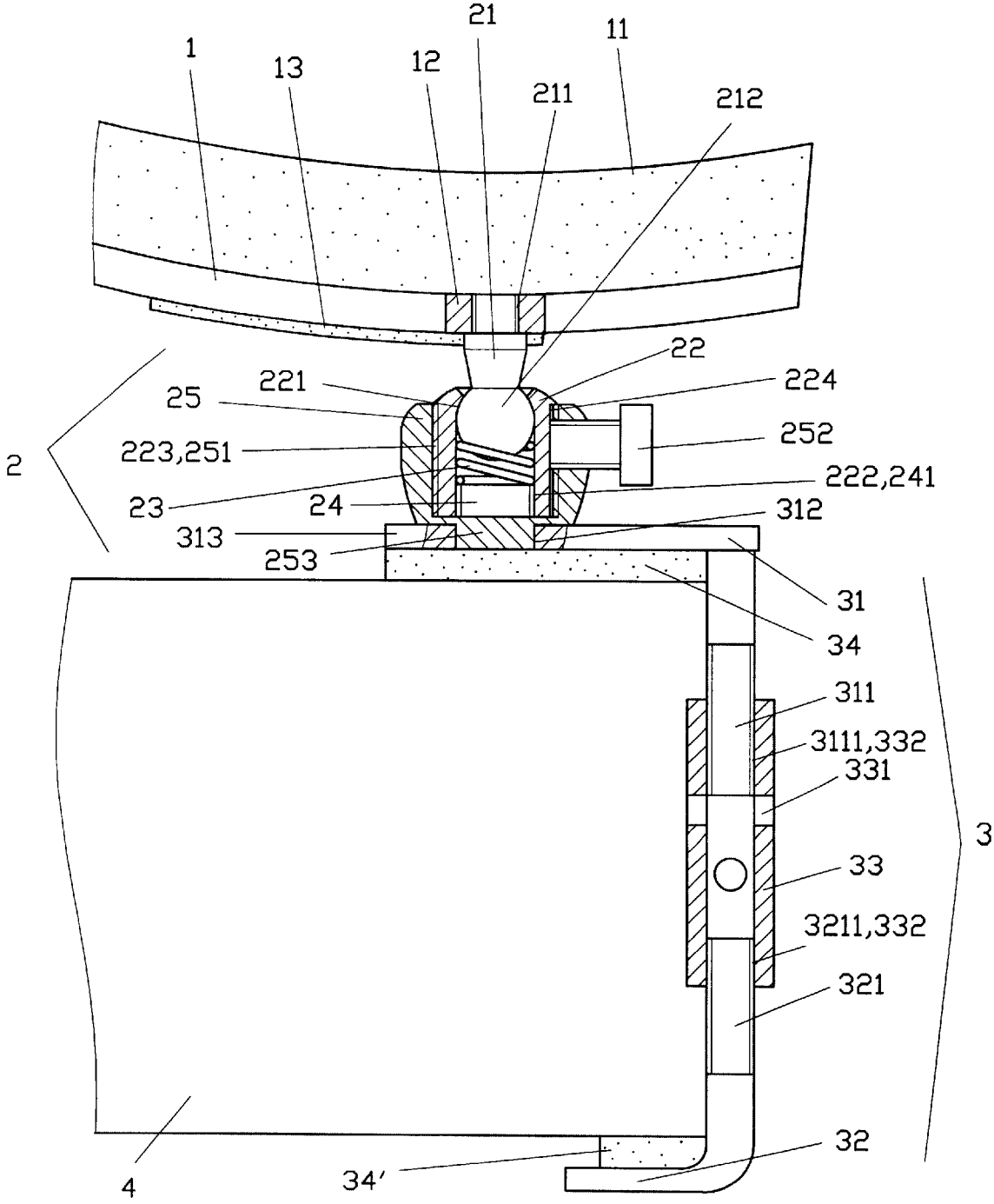
FIG. 3 is a front cross-sectional view of the present invention.

To assemble the present invention, as shown in FIGS. 2 and 3, the adjusting rod 21 of the adjusting device 2 is inserted into the connecting base 22 with the bolt 212 engaging with the arcuate surface 221, and the spring 23 is inserted into the connecting base 22 underneath the bolt 212, and then the block 24 is threaded into the connecting base 22 so as to secure the adjusting rod 21 in the connecting base 22. The threaded section 211 of the adjusting rod 21 is threaded into the threaded blind hole 12 and locked thereat, then the sleeve 25 is threaded onto the connecting base 22 with the female threads 251 threading onto the male threads 223 of the connecting base 22. The boss 253 of the sleeve 25 is secured to the hole 312 of the plate 31 of the fixture 3. The sleeves 33 are rotated to adjust the rods 311 and 312 up and down, which may be adjusted the tightness of the plates 31 and 32 with respect to the violin 4.

Figure 4:
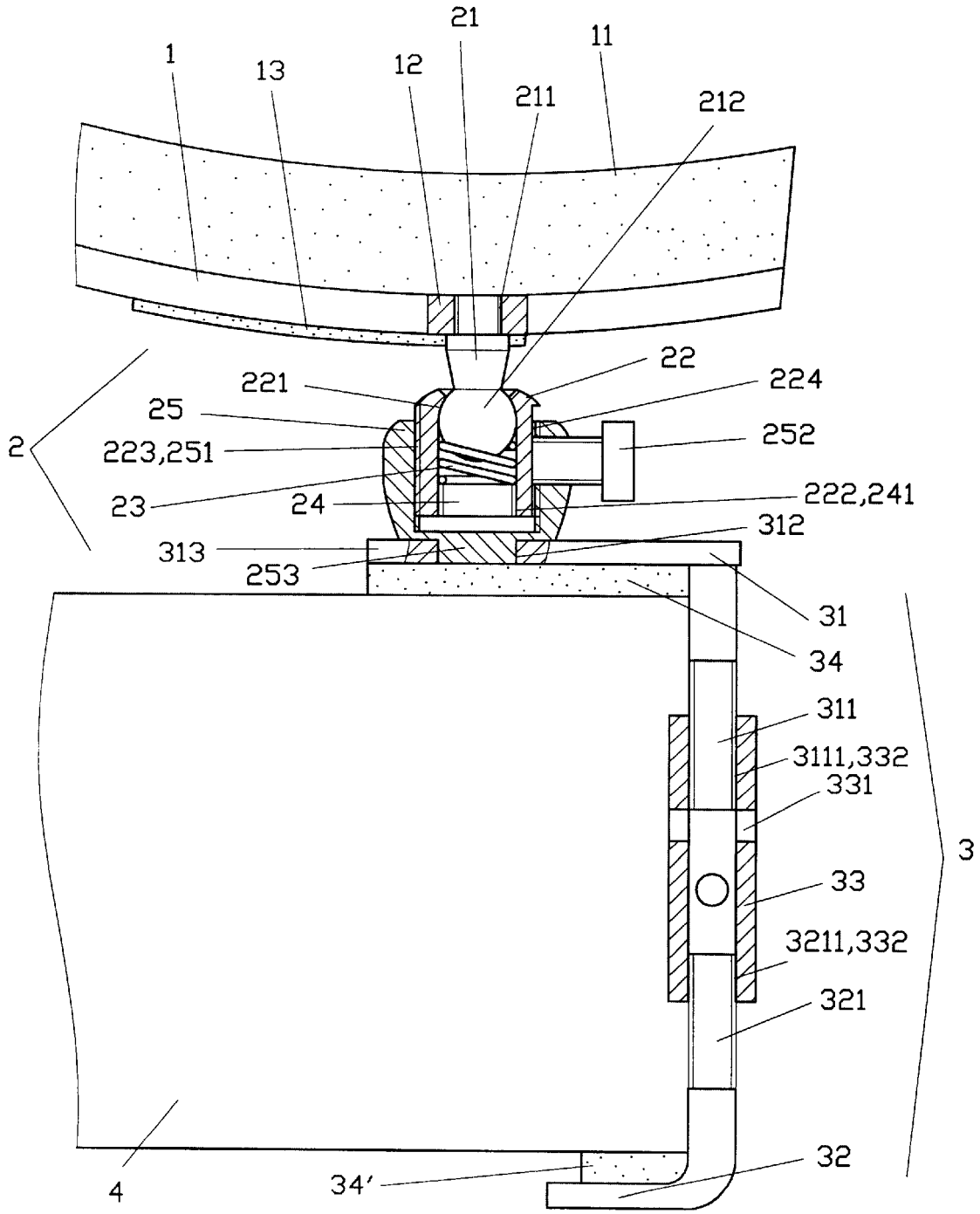
FIG. 4 is a front view of the present invention, showing adjustment of the height of a chin rest pad of the present invention.

To operate the present invention, as shown in FIGS. 3 and 4, when the connecting base 22 of the adjusting device 2 is rotated, the male threads 223 mesh with the female threads 251 of the sleeve 25 to move the chin rest pad 1 upward or downward. Upon the chin rest pad 1 has adjusted to the most appropriate position, the position bolt 252 is tightened to engage with the stop line 224 of the connecting base 22 to prevent the connecting base 22 from moving upward or downward.

Figure 5:
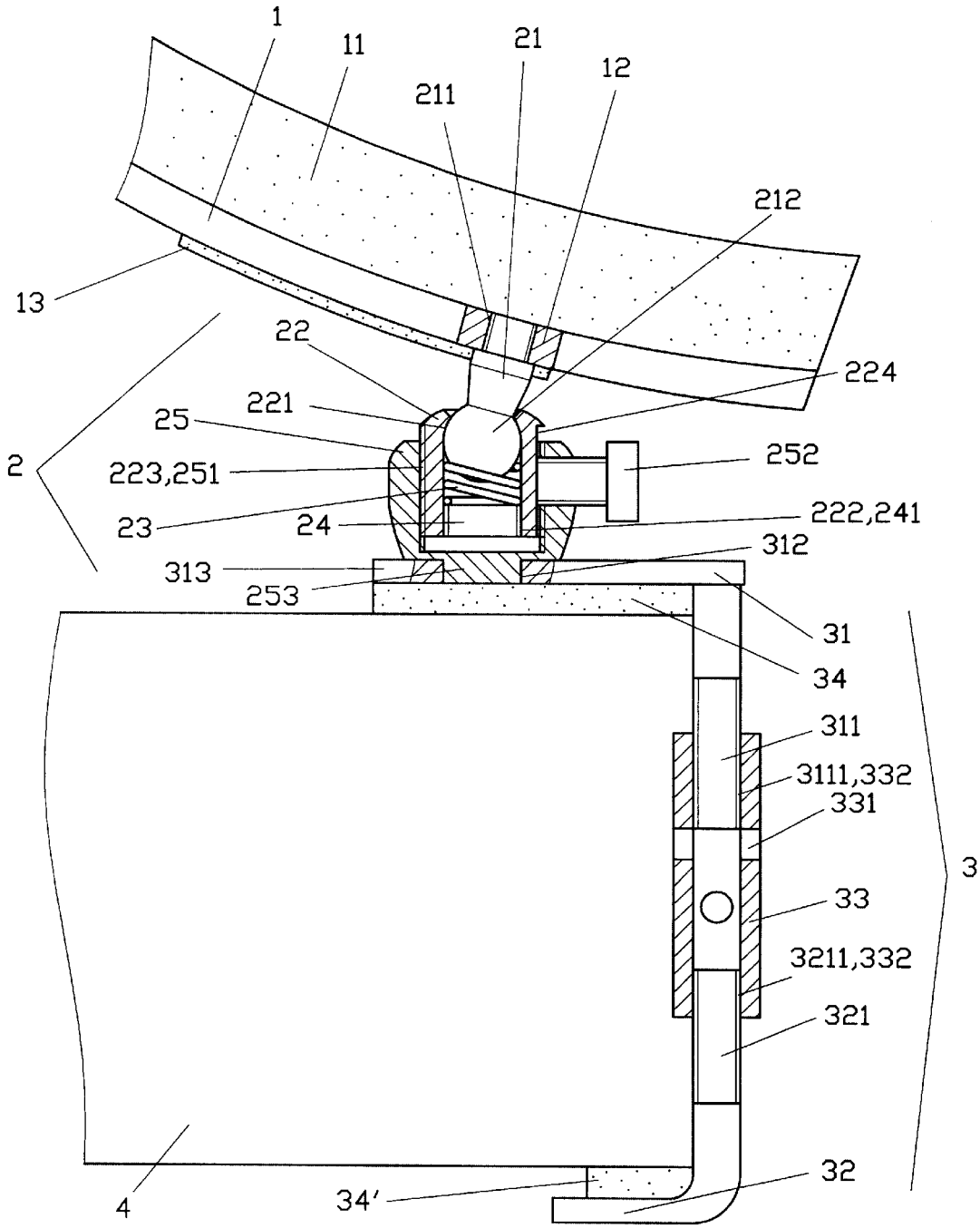
FIG. 5 is a front view of the present invention, showing adjustment of the angle of the chin rest pad of the present invention.
Figure 6:
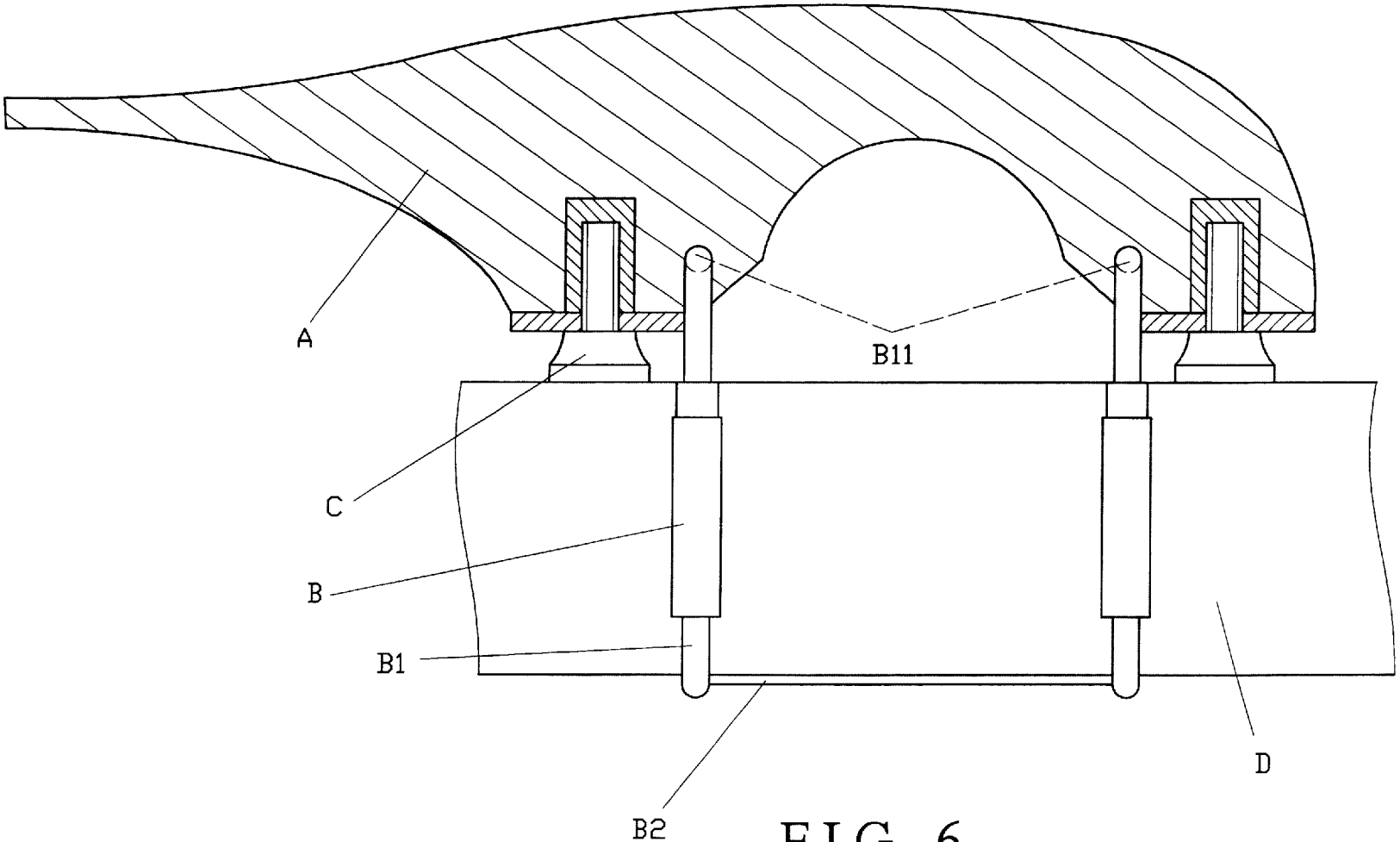
FIG. 6 (PRIOR ART)
FIG. 6 is a side cross-sectional view of a prior art.

FIG. 5 shows the angle adjustment of the chin rest pad 1. As the bolt 212 of the adjusting device 2 is a ball shape, it engages with the arcuate surface 221 of the connecting base 22 and is able to spin to any direction, which brings the chin rest pad 1 in different angle to make a performer comfortable.

Further, as the chin rest pad 1 is secured to the threaded blind hole 12 by the adjusting rod 21, it may be replaced solely when the chin rest pad 1 is worn or broken.

I claim:

1. A violin chin rest comprising a chin rest pad, an adjusting device, and a fixture being secured to a violin;

said adjusting device comprising an adjusting rod, a connecting base and a sleeve, wherein said adjusting rod having one end connected to said chin rest pad while another end having a ball-shaped bolt, said connecting base comprising an arcuate inner surface and male threads on an outer surface, said sleeve comprising female threads on an inner wall with one end connected to said fixture, thus said adjusting rod being secured to said connecting base with said bolt engaging with said arcuate surface so as to adjust various angles of said chin rest pad, and said connecting base being secured with said sleeve for adjustment of height of said chin rest pad.

2. The violin chin rest, as recited in claim 1, wherein said adjusting device further comprises a spring, and a block, said block comprising male threads on an outer surface corresponding to female threads of said connecting base, said spring and said block being inserted into said connecting base and secured therein.

3. The violin chin rest, as recited in claim 1, wherein said connecting base of said adjusting device comprises a stop line, and said sleeve comprises a position bolt to tighten said stop line of said connecting base.

4. The violin chin rest, as recited in claim 1, wherein said chin rest pad comprises a buffer pad at a bottom end.

5. The violin chin rest, as recited in claim 1, wherein said chin rest pad comprises a soft pad at an upper surface.

* * * * *